US010472746B2

(12) United States Patent
Yuan et al.

(10) Patent No.: US 10,472,746 B2
(45) Date of Patent: Nov. 12, 2019

(54) LIGHT-WEIGHT HIGH-STRENGTH FABRIC FOR FENCING PROTECTIVE CLOTHING AND PREPARATION PROCESS THEREOF

(71) Applicants: Mingfu Yuan, Jiangsu (CN); Chao Yuan, Jiangsu (CN)

(72) Inventors: Mingfu Yuan, Jiangsu (CN); Chao Yuan, Jiangsu (CN)

( * ) Notice: Subject to any disclaimer, the term of this patent is extended or adjusted under 35 U.S.C. 154(b) by 98 days.

(21) Appl. No.: 15/576,793

(22) PCT Filed: Dec. 15, 2015

(86) PCT No.: PCT/CN2015/097444
§ 371 (c)(1),
(2) Date: Nov. 24, 2017

(87) PCT Pub. No.: WO2016/188097
PCT Pub. Date: Dec. 1, 2016

(65) Prior Publication Data

US 2018/0163329 A1 Jun. 14, 2018

(30) Foreign Application Priority Data

May 25, 2015 (CN) ..... 2015 1 0272671

(51) Int. Cl.

| | |
|---|---|
| ***D04B 1/22*** | (2006.01) |
| ***D04B 1/14*** | (2006.01) |
| ***A41D 31/00*** | (2019.01) |
| ***D04B 1/16*** | (2006.01) |
| ***D04B 21/16*** | (2006.01) |

(52) U.S. Cl.
CPC ..... *D04B 1/14* (2013.01); *A41D 31/00* (2013.01); *D04B 1/16* (2013.01); *D04B 1/22* (2013.01); *D04B 21/16* (2013.01); *D10B 2501/04* (2013.01)

(58) Field of Classification Search
CPC ... D04B 1/14; D04B 1/16; D04B 1/24; D04B 1/22; D04B 9/06; D04B 9/38; D02G 3/442; D02G 3/04
See application file for complete search history.

(56) References Cited

U.S. PATENT DOCUMENTS

| | | | | |
|---|---|---|---|---|
| 5,655,358 | A * | 8/1997 | Kolmes | D02G 3/12 57/212 |
| RE38,136 | E * | 6/2003 | Kolmes | D02G 3/12 57/212 |
| 6,701,703 | B2 * | 3/2004 | Patrick | D02G 3/12 57/211 |
| 7,214,425 | B2 * | 5/2007 | Kolmes | D02G 3/047 428/357 |
| 8,276,405 | B2 * | 10/2012 | Ogata | D04B 1/16 66/171 |
| 8,887,534 | B2 * | 11/2014 | Garcia | B32B 5/26 66/202 |
| 9,994,979 | B2 * | 6/2018 | Kolmes | A41B 11/00 |
| 10,161,065 | B2 * | 12/2018 | Ogata | D04B 1/22 |
| 2006/0223400 | A1 * | 10/2006 | Yasui | A41B 17/00 442/181 |
| 2009/0004469 | A1 * | 1/2009 | Yoshimoto | D01F 8/12 428/370 |
| 2010/0050699 | A1 * | 3/2010 | Kolmes | A41B 9/00 66/174 |
| 2013/0239289 | A1 * | 9/2013 | Iwashita | D02G 1/02 2/69 |
| 2018/0163329 | A1 * | 6/2018 | Yuan | A41D 31/00 |

FOREIGN PATENT DOCUMENTS

| | | | |
|---|---|---|---|
| CN | 101185532 | A | 5/2008 |
| CN | 202286417 | U | 7/2012 |
| CN | 102783728 | A | 11/2012 |
| CN | 203137080 | U | 8/2013 |
| CN | 104246039 | A | 12/2014 |
| WO | 2003083196 | A1 | 10/2003 |

* cited by examiner

*Primary Examiner* — Danny Worrell
(74) *Attorney, Agent, or Firm* — Novick, Kim & Lee, PLLC; Allen Xue

(57) ABSTRACT

A light-weight high-strength fabric for fencing protective clothing uses UHMWPE fibers with fiber number of 360-420 D and high-strength terylene silks with fiber number of 460-540 D as raw materials. The fabric is prepared through the steps of batching, twisting, weaving, and after-treatment. The resulting fabric has less defects due to improvements in fabric formula and weaving techniques, etc. The puncture strength of the fabric can reach 3300 N, and the mass per unit area can be reduced to 600 g/m$^2$.

8 Claims, No Drawings

LIGHT-WEIGHT HIGH-STRENGTH FABRIC FOR FENCING PROTECTIVE CLOTHING AND PREPARATION PROCESS THEREOF

TECHNICAL FIELD

The present invention relates to the technical field of textile material, especially to a light-weight high-strength fabric for fencing protective clothing and preparation process thereof.

BACKGROUND ART

Fencing has been becoming more and more popular since being an Olympic sport in 1896, and the number of participants has risen in an explosive manner in recent years. Accordingly, more attention was paid to the research about fencing protective clothing. And the technology progress of fencing protective clothing plays an important role in the steady development of the competitive sport with high risk and strong antagonism.

Desired properties of fencing protective clothing include light weight, high strength, good softness and comfort. In view of the requirements, some products have been available commercially, such as Dyneema fencing clothing from DSM and ALLSTAR fencing clothing. Along with the development of the sport, however, better performance is in need, especially protective performance and comfort.

As illustrated in CN102090741A, CN102963078A, CN103462276A, CN201869837U, et al, the research to fencing protective clothing at present is mainly focused on multi-layer composite fabric. The materials used in these fabrics usually contain high-strength fibers such as ultra-high molecule weight polyethylene (UHMWPE), aramid, and polypropylene. It is hoped to obtain satisfactory protective performance and comfort through the adjustment of the structure and material of multi-layer fabric. In addition, there are some reports in the new material area. For example, a flexible light liquid, stab-proof material for fencing protective clothing is disclosed in CN102692161A, which is formed through the integration of a non-weft cloth of high-strength fiber, a three-dimensional hollow-structured fabric of high-strength fiber, and a liquid with shear thickening characteristics by a hot sewing technology.

Limited to the materials and/or process, however, the fabrics mentioned above are still inadequate in light weight, protective strength, flexibility and comfort. And multi-layer structure relates to more complicated production process and higher cost.

DETAILED DESCRIPTION OF THE INVENTION

The purpose of the present invention is to provide a light-weight high-strength fabric for fencing protective clothing and preparation process thereof. Based on the improvement of the formula and the weaving technology, a fabric with high protective strength, low mass per unit area, soft and comfortable feel is obtained. Only one weaving operation is involved in the preparation process. The fabric of the invention is obviously superior to the existing similar products.

A preparation process of a fabric for fencing protective clothing, UHMWPE fibers and high-strength terylene silks used as raw materials, comprises the following steps:

A) Batching

UHMWPE fibers with fiber number of 360-420 D and high-strength terylene silks with fiber number of 460-540 D are selected as raw materials;

B) Twisting

The UHMWPE fibers and terylene silks are twisted, and the degree of twist is controlled to be 70-100 twists per meter (T/m);

After the twisting processing, the breaking strength of single UHMWPE fiber is 15-20 kg, and the breaking strength of single terylene silk is 6-8 kg;

C) Weaving

Weaving is performed by using a double-side circular knitting machine;

The needle array is as follows:

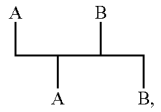

wherein, A and B represent two kinds of knitting needle with different needle butt, the needles upper to the horizontal line represent dial knitting needles, and the needles nether to the horizontal line represent cylinder knitting needles;

The triangle array is as shown in the following table:

| | | Road | | | | | | | |
|---|---|---|---|---|---|---|---|---|---|
| Needle | | 1 | 2 | 3 | 4 | 5 | 6 | 7 | 8 |
| Dial | A | ∧ | — | — | — | — | — | ∧ | — |
| | B | — | — | ∧ | — | ∧ | — | — | — |
| Cylinder | A | Π | — | — | ∧ | — | ∧ | — | — |
| | B | — | ∧ | — | — | Π | — | — | ∧ |

wherein, knit cam "∧" represents that the knitting needle joins in the weaving operation in the manner of full stitch, tuck cam "Π" represents that the knitting needle joins in the weaving operation in the manner of half stitch, flat cam "-" represents that the knitting needle does not join in the weaving operation, the knitting raceways of "A" and "B" is different, and the number "1-8" represent the roads of feeding yarn;

D) After-Treatment

Successively, the as-obtained fabric in step C) is bleached, dried, treated by a soft liquid, then dried and sized.

In step A) of the present invention, fiber number of the UHMWPE fibers is 360-420 D (i.e. denier), and the density is usually 0.94-0.98 g/cm$^3$. Structure parameter of the fibers is strongly correlated with its strength and processibility, and plays an important role in the performance of the final fabric product. Preferably, fiber number of the UHMWPE fibers is 390-410 D, and the density is 0.97-0.98 g/cm$^3$. It is not limited that applicable UHMWPE fibers are available commercially, such as Dyneema® from DSM of Netherlands, Spectra® from Honeywell of USA, BEST® lylon from Yizheng Chemical Fiber co. LTD of Sinopec.

In step A), fiber number of the high-strength terylene silks is 460-540 D, preferably 490-510 D. It is not limited that applicable high-strength terylene silks can be obtained commercially, such as the products available from Changshu Xieming high-strength polyester co. LTD.

In step B), twisting processing can further enhance the strength of the fibers and silks, and the strength has a great influence on its processibility and the protective strength of the fabric. If the strength is too low, the protective strength of the fabric can not meet the requirement. If the strength is too high, it will lead to the loss of processibility and comfort. The strength of the fibers and silks should match to each other so that the synergistic effect can be ensured in subsequent fabric tissues. The degree of twist is preferably controlled to be 80-90 twists per meter (T/m). After the twisting processing, the breaking strength of single UHMWPE fiber and single terylene silk should be 15-20 kg and 6-8 kg respectively. The term "breaking strength" mentioned here refers to the maximum weight that single fiber/silk can bear before breaking, which can be measured by hanging weights on the fiber/silk.

The weaving mentioned in step C), which is carried out by using a circular knitting machine at room temperature such as 15-25° C., is the key to achieve the purpose of the invention. The machine used in the weaving process is a double-side circular knitting machine. It is very easy for a person skilled in the art to confirm the suitable machine model. For example, an existing product with the model 60RG can be used.

During the weaving, as shown above, a cycle consists of 8 roads of feeding yarn, forming a complete weave structure. By changing the ratio of UHMWPE fiber and terylene silk in the roads of feeding yarn, the composition of the fabric can be adjusted effectively, and then the physical property of the fabric is regulated. In consideration of the protective strength of the fabric, the ratio of UHMWPE fiber and terylene silk in the roads should be more than 3:1 such as 3:1 or 7:1, or the fabric can be made of the UHMWPE fibers entirely. Along with the increase of the UHMWPE content in the fabric, protective strength of the fabric increases accordingly.

The after-treatment in step D), including the steps of bleaching, drying, treating by a soft solution, drying and sizing, is a conventional technique in the field of textile material. For example, the fabric is bleached at 90-105° C., then goes through a soft solution at a constant speed after drying. The amount of softening agent in the soft solution is usually 0.6-1.0% based on the weight of the fabric to be processed. Subsequently, the fabric is dried and sized at 90-110° C.

Optionally, the preparation process of the invention can comprise other conventional steps in addition to the steps A-D, such as printing and dyeing, so as to make the fabric product meet the personalized needs of different customers.

Accordingly, a fabric for fencing protective clothing prepared by the preparation process mentioned above is provided.

Based on the improvement of the fabric formula and the weaving technology, the as-obtained fabric for fencing protective clothing has no defects of a multilayer fabric. The puncture strength of the fabric can reach 3300 N, and the mass per unit area can be reduced to 600 g/m$^2$. A soft and comfortable feel is realized. Furthermore, only one weaving operation is involved in the preparation process. The preparation process is simple and low-cost.

EXAMPLES

Hereafter, this invention will be illustrated in conjunction with specific examples, but it is not to be understood that the scope of this invention is limited thereto.

The technical parameters that are not specified in the examples can be performed in accordance with the conventional conditions in this field or the requirements of the equipment specification.

Example 1

Fabric I for fencing protective clothing, the preparation process comprises the following steps:

A) Batching

UHMWPE fibers with fiber number of 400 D (BEST® lylon product, 400 D/230 F, the density is 0.97 g/cm$^3$) and high-strength terylene silks with fiber number of 500 D (purchased from Changshu Xieming high-strength polyester co. LTD, 500 D/144 F, FDY) are selected as raw materials;

B) Twisting

The fibers and silks are twisted, and the degree of twist is controlled to be 80-90 T/m;

After the twisting processing, the breaking strength of single UHMWPE fiber is about 18 kg, and the breaking strength of single terylene silk is about 8 kg;

C) Weaving

Weaving is performed by using a double-side circular knitting machine at room temperature (about 20° C.);

The needle array is as follows:

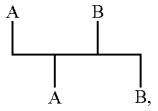

wherein, A and B represent two kinds of knitting needle with different needle butt, the needles upper to the horizontal line represent dial knitting needles, and the needles nether to the horizontal line represent cylinder knitting needles;

The triangle array is as shown in the following table:

| Needle | | Road 1 | 2 | 3 | 4 | 5 | 6 | 7 | 8 |
|---|---|---|---|---|---|---|---|---|---|
| Dial | A | ∧ | — | — | — | — | — | ∧ | — |
| | B | — | — | ∧ | — | ∧ | — | — | — |
| Cylinder | A | Π | — | — | ∧ | — | ∧ | — | — |
| | B | — | ∧ | — | — | Π | — | — | ∧ |

wherein, knit cam "∧" represents that the knitting needle joins in the weaving operation in the manner of full stitch, tuck cam "Π" represents that the knitting needle joins in the weaving operation in the manner of half stitch, flat cam "-" represents that the knitting needle does not join in the weaving operation, the knitting raceways of "A" and "B" is different, and the number "1-8" represent the roads of feeding yarn;

The ratio of UHMWPE fiber and terylene silk in the roads of feeding yarn is 3:1;

D) After-Treatment

The fabric obtained in step C) is bleached at 100° C., then goes through a soft solution at a constant speed after drying. The amount of cationic softening agent in the soft solution is 0.8% based on the weight of the fabric to be processed. Subsequently, the fabric is dried and sized at 100° C. As a result, white knitted fabric I is obtained.

Example 2

Fabric II for fencing protective clothing: A preparation process is performed according to example 1, except that the ratio of UHMWPE fiber and terylene silk in the roads of feeding yarn is 7:1. As a result, white knitted fabric II is obtained.

Example 3

Fabric III for fencing protective clothing: A preparation process is performed according to example 1, except that the fabric is made of the UHMWPE fibers entirely. As a result, white knitted fabric III is obtained.

Comparative Example

A fencing protective clothing of ALLSTAR 800NW, which is available commercially, is used as comparative fabric.

Performance Characterization

Puncture strength and mass per unit area of the fabrics of example 1-3 and comparative example are tested respectively. The puncture strength is tested by reference to GB/T 19978-2005, and the mass per unit area is tested by reference to GB/T 4669-2008.

The test results are shown in the table below.

| Sample | Puncture strength (N) | Mass per unit area (g/m$^2$) |
|---|---|---|
| Fabric I | 2612 | 600 |
| Fabric II | 3117 | 606 |
| Fabric III | 3324 | 610 |
| Comparative fabric | 2193 | 739 |

As shown in the table, the fabrics I-III of the present invention have significantly higher puncture strength and lower mass per unit area than the comparative fabric. And it can be intuitively recognized from the touch that the fabrics of this invention have better softness and higher comfort level.

In conclusion, the fabric of the present invention can lead to better protection performance, lower weight, better softness and higher comfort level when it is used for fencing protective clothing. Its application performance is obviously superior to similar products, implying that it has a broad application prospect in the field of fencing clothing.

The invention claimed is:

1. A preparation process of a fabric comprising:

Step (1): selecting a UHMWPE fiber with a fiber number of 360-420 D and terylene silk with a fiber number of 460-540 D as raw materials;

Step (2):

twisting the UHMWPE fiber and the terylene silk at a number of twist of 70-100 T/m to form a yarn, wherein a breaking strength of a single strand of the UHMWPE fiber is 15-20 kg, and a breaking strength of a single strand of the terylene silk is 6-8 kg;

Step (3): knitting the yarn from Step (2) using a double-side circular knitting machine to form a fabric, wherein a needle array for the knitting machine is

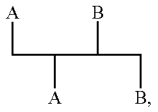

wherein, A and B represent two kinds of knitting needles having different needle butts, the needles above the horizontal line represent dial knitting needles, and the needles below the horizontal line represent cylinder knitting needles;

wherein a triangle array for the knitting machine is as shown in the following table:

| Needle | | Road 1 | 2 | 3 | 4 | 5 | 6 | 7 | 8 |
|---|---|---|---|---|---|---|---|---|---|
| Dial | A | ∧ | — | — | — | — | — | ∧ | — |
| | B | — | — | ∧ | — | ∧ | — | — | — |
| Cylinder | A | Π | — | — | ∧ | — | ∧ | — | — |
| | B | — | ∧ | — | — | Π | — | — | ∧ |

wherein knit cam "∧" represents that the corresponding knitting needle knits is at a full stitch, tuck cam "Π" represents that the corresponding knitting needle knits is at a half stitch, flat cam "-" represents that the corresponding knitting needle does not participate in knitting, the knitting raceways of A and B are different, and numbers 1 to 8 represent the number of roads of feeding yarn; and Step (4): successively subjecting the fabric obtained from Step (3) to bleaching, drying, treating with a soft liquid, drying, and sizing.

2. The preparation process of a fabric for fencing protective clothing according to claim 1, wherein a density of the UHMWPE fiber in Step (1) is 0.94-0.98 g/cm$^3$.

3. The preparation process of a fabric for fencing protective clothing according to claim 1, wherein a fiber number of the UHMWPE fibers in Step (1) is 390-410 D, and a density the UHMWPE fibers in Step (1) is 0.97-0.98 g/cm$^3$.

4. The preparation process of a fabric for fencing protective clothing according to claim 1, wherein a fiber number of the terylene silk in Step (1) is 490-510 D.

5. The preparation process of a fabric for fencing protective clothing according to claim 1, wherein the number of twists is 80-90 T/m in Step (2).

6. The preparation process of a fabric for fencing protective clothing according to claim 1, wherein a ratio of the UHMWPE fiber and the terylene silk in the roads of feeding yarn is more than 3:1 in Step (3).

7. The preparation process of a fabric for fencing protective clothing according to claim 1, wherein the ratio of the UHMWPE fiber and the terylene silk in the roads of feeding yarn is 3:1 or 7:1 in Step (3).

8. A fabric for fencing protective clothing, wherein it is prepared by the preparation process according to claim 1.

* * * * *